United States Patent [19]

Ogawa et al.

[11] Patent Number: 4,483,170

[45] Date of Patent: Nov. 20, 1984

[54] PRESS MACHINE STRUCTURE

[75] Inventors: Nitsuo Ogawa, Toyota; Akira Shimizu, Fuzi, both of Japan

[73] Assignees: Toyota Jidosha Kabushiki Kaisha, Toyota; Marusun Suruga Kogyosho Co., Ltd., Fuji, both of Japan

[21] Appl. No.: 450,431

[22] Filed: Dec. 16, 1982

[51] Int. Cl.[3] ..... B21D 28/18; B21D 28/26

[52] U.S. Cl. ..... 72/327; 72/326; 72/465; 72/351

[58] Field of Search ..... 72/327, 326, 328, 329, 72/325, 333–337, 464, 465, 350, 351, 347; 83/139, 138, 582, 542

[56] References Cited

U.S. PATENT DOCUMENTS

| | | | |
|---|---|---|---|
| 1,904,920 | 4/1933 | Hothersall | 72/350 |
| 2,251,433 | 8/1941 | Wareham | 72/328 |
| 2,312,749 | 3/1943 | Bullock | 72/327 |
| 2,899,922 | 8/1959 | Wheeler | 72/336 |
| 3,252,315 | 5/1966 | Muench | 72/328 |
| 3,336,117 | 8/1967 | Borello | 72/327 |
| 3,395,562 | 8/1968 | Bushi | 72/350 |
| 4,309,888 | 1/1982 | Miller et al. | 72/334 |

FOREIGN PATENT DOCUMENTS

| | | | |
|---|---|---|---|
| 428638 | 7/1967 | Switzerland | 72/347 |

*Primary Examiner*—Daniel C. Crane

*Attorney, Agent, or Firm*—Cushman, Darby & Cushman

[57] ABSTRACT

A press machine structure wherein a work stock is set on a lower die having a die, and an upper die engageable with the lower die is lowered so as to press the work stock against the lower die for deforming the same, while a pad presses and fixes the portion of the work stock at the peripheral edge of the die as the upper die effects working and at the same time, the punch statically contacts with the work stock, and then, a push rod provided to the upper die presses the punch to project out and face to the die for punching the work stock, thereby allowing bending and punching to be continuously effected.

2 Claims, 4 Drawing Figures

PRESS MACHINE STRUCTURE

BACKGROUND OF THE INVENTION (1) Field of the Invention

The present invention relates to a press machine structure provided to a bending machine with an upper die and a lower die, wherein a pad, which is suspended through a spring means from a ram having the upper die suspended therefrom, has a punch, while the lower die is provided with a die engageable with the punch. More particularly, the invention pertains to a press machine structure wherein the above-mentioned punch is connected with the above-mentioned pad through another spring means, while a push rod provided to the above-mentioned upper die has a step portion and faces the punch so that the punch can be pressed through the step portion so as to be able to advance to and retreat from the above-mentioned die.

(2) Description of the Prior Art

As is generally known, when the car body of an automobile is pressed, two processes, i.e., a bending process and a punching process, are necessary on the grounds of the structure of the body.

Accordingly, such a form has been devised and conventionally employed as follows. As shown in FIG. 1, first, in a bending operation as a first process, a work stock 4 having a portion 3 to be punched out is properly set on a lower die 2 of a press machine 1 as a bending press. Then, a ram 5 is lowered from the upper side. In consequence, a pad 8, which is suspended through compression springs 7, 7 as spring means from an upper die 6 suspended from the ram 5 and is projected from the upper die 6, presses the portion 3 to be punched out of the work stock 4. As a result, the portion 3 to be punched out is clamped between the lower die 2 and the pad 8 and at the same time, the upper die 6 contacts with the work stock 4 and presses the same to be plastically deformed and moreover, the upper die 6 brings the work stock 4 into pressure-contact with the lower die 2 to form a work 4' with a given shape.

Thereafter, the ram 5 is reset to a given posture, and the work 4' thus pressed is removed and carried to a punching press in the subsequent process, where the portion 3 to be punched out is punched out.

The conventional method, therefore, has such a problem that the process is complicated, since there is a need for two processes in working the work stock 4.

Moreover, there is such a problem that it is necessary to install a transfer apparatus and the like between the processes, so that the installation cost increases and the greatest care is needed for also the maintenance of the work 4' in the transfer course. As a result, the manhour increases, and consequently the cost becomes higher.

Furthermore, there is also such a disadvantage that the reproducibility of the working position of the work 4' set on the punching press in the subsequent process is bad, so that there is a need for a skill in setting of the work 4'.

It is a matter of course that such a form has been devised and employed for coping with the above-mentioned problems and disadvantages as follows. As shown in FIG. 2, a die 9 is integrally provided to a lower die 2' of a press machine 1', and a punch 10 engageable with the die 9 is mounted on an upper die 6' suspended from the ram 5, the punch 10 being projected from the upper die 6'. On the other hand, a pad 8' is fitted around the whole circumference of the punch 10, the pad 8' being further projected from the punch 10. Consequently, as the ram 5 lowers, the upper die 6' presses the work stock 4 set on the lower die 2' and at the same time, the pad 8' contacts with the work stock 4, thereby allowing the periphery of a portion 3' to be punched out of the work stock 4 to be clamped by the peripheral edge of the die 9 and the pad 8'. Then, the upper die 6' approaches to the lower die 2' in order to plastically deform the work stock 4 into a given bent shape and at the same time, the punch 10 lowers to punch out the portion 3' to be punched out, forming a hole, and engages with the die 9. The portion 3' to be punched out is discharged from a passage 12, as a punching scrap 3''.

However, although the above-described form has such a merit that bending and punching are simultaneously effected, there is such a shortcoming that the fitting space of the pad 8' is regulated owing to the working design restrictions of the upper die 6' and the punch 10 and therefore, a satisfactory rigidity cannot be guaranteed in pressing the work stock 4, so that warpage may be produced at the peripheral edge of the hole in punching.

Moreover, there is also such a shortcoming that since punching is effected by an impact load, in bending a tensile stress is spread to the hole previously formed by punching, causing the hole to be deformed.

SUMMARY OF THE INVENTION

It is, therefore, an object of the present invention to provide an excellent press machine structure allowing a single apparatus to efficiently perform a plurality of working operations, wherein a recess is formed in the pad suspended from the upper die through spring means, and the punch is fitted and retained in the recess by means of another spring means as well as adapted to be able to project and retreat by means of a push rod provided to the upper die in order to make the punch perform a static loading operation so that bending and punching can be continuously effected, thereby solving the above-mentioned problems in combination of the bending and punching operations of a press machine in accordance with the prior art.

DESCRIPTION OF THE PREFERRED EMBODIMENTS

Figure 3:
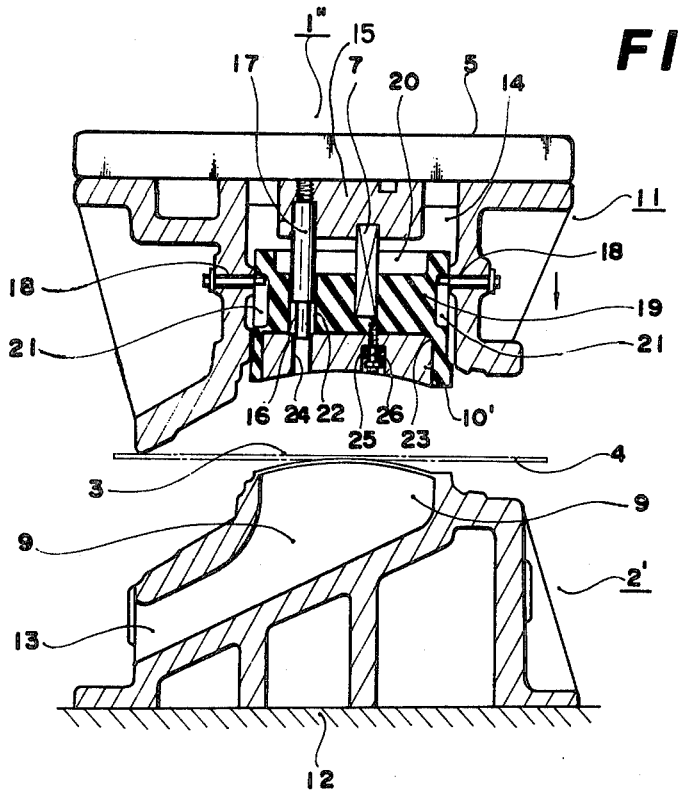
FIG. 3 schematically illustrates a preferred embodiment of the invention.

In FIG. 3, a press machine 1'', which constitutes the subject matter of the invention, has a lower die 2' and an upper die 11.

Figure 2:
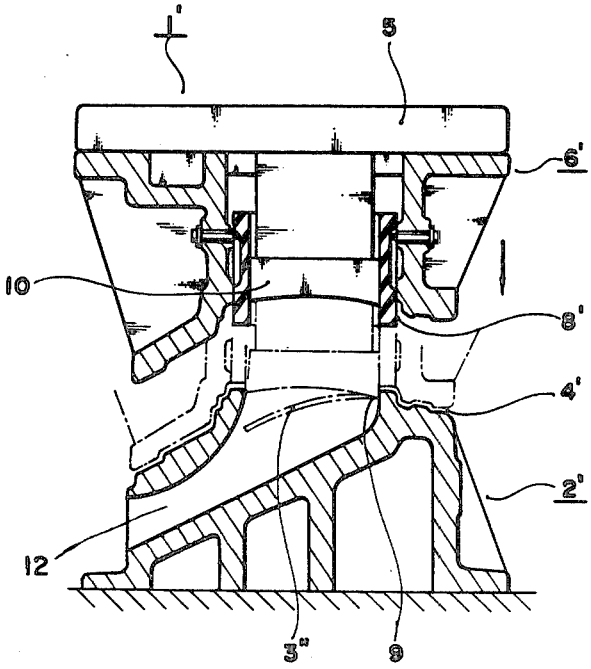
FIG.2 PRIOR ART
FIG. 2 schematically illustrates another press machine in accordance with the prior art.

Similarly to that shown in FIG. 2, described above, the lower die 2' mounted on a frame 12 is integrally provided with a die 9 communicating with a passage 13. On the other hand, the upper die 11 capable of approaching to and separating from the lower die 2' is located above the same and suspended from a ram 5 as well as has a cavity 14. A boss 15 provided in the cavity 14 suspends a compression spring 7 as a spring means and a push rod 17 having a step portion 16 provided at the end. Moreover, engaging pins 18, 18 are secured to the side surfaces of the cavity 14, projecting their ends inwardly.

A hard rubber pad 19 is fitted in the cavity 14, having a recess 20 bored in the upper surface thereof and adapted to be able to contact with and separate from the boss 15, and grooves 21, 21 formed on the side surfaces thereof and adapted to be slidably engaged with the engaging pins 18, 18 to form a lost motion connection between the pad 19 and the upper die 11. Moreover, the end of the compression spring 7 is secured to the upper surface of the hard rubber pad 19. On the other hand, the push rod 17 is received by a slide bush 22, as a guide, fitted in the pad 19.

A recess 23 formed on the bottom surface of the pad 19 is fitted with a punch 10' having a slide bush 24 fitted therein for receiving the step portion 16 of the push rod 17 to provide lost motion engagement between the push rod 17 and the punch 10'. The proximal end of a pusher pin 26, as a spring means, embedded in the punch 10' and fitted with a compression pin 25 is screwed to the bottom surface of the recess 23 so that the punch 10' can project from and retreat into the bottom surface recess 23, thereby allowing the punch 10' to engage with and disengage from the die 9 through the step portion 16.

It is to be noted that the contact surfaces between the boss 15 and the recess 20, those between the bottom surface recess 23 and the punch 10' and those between the proximal end of the step portion 16 and the punch 10' are rough-finished (▽▽), and the peripheral edge of the bottom surface recess 23 is slightly projected from the punch 10'.

Figure 1:
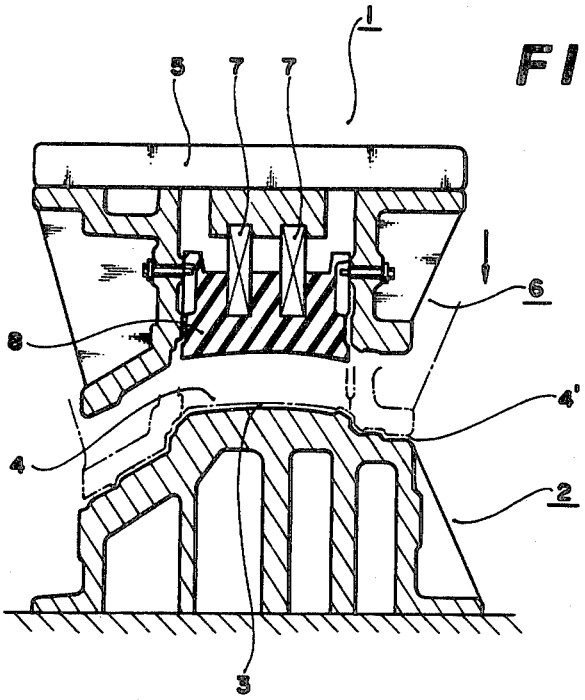
FIG.1 PRIOR ART
FIG. 1 schematically illustrates a press machine in accordance with the prior art.

A reference numeral 4 denotes a work stock having a portion 3 to be punched out, similarly to that in FIG. 1 described above.

In the above-described arrangement, when the ram 5 is in the lifted state as its initial posture, the pad 19 is pushed out by means of the compression spring 7, and the engaging pins 18, 18 are engaged with the grooves 21, 21 of the pad 19, respectively, so that the pad 19 is retained being separated by a given distance from the boss 15 of the upper die 11 suspended from the ram 5. On the other hand, the punch 10' is held within the bottom surface recess 23 of the pad 19 by means of the pusher pin 26.

Then, the work stock 4 is set on the lower die 2' by means of a setting device, not shown, so that the work stock 4 is directed in its working direction and the portion 3 to be punched out of the work stock 4 is positioned on the die 9 of the lower die 2'.

Next, as a start switch, not shown, is made ON, the ram 5 having been lifted up by a proper crank means starts lowering.

In consequence, the upper die 11, the boss 15, the pad 19, the punch 10' and the like, which are suspended from the ram 5, lower simultaneously.

Thereupon, the upper die 11 applies an external pressure to the work stock 4, causing the same to be gradually deformed as well as approach to the lower die 2'.

Meantime, the peripheral edge of the bottom surface recess 23 of the pad 19 being pushed out from the cavity 14 of the upper die 11 by means of the compression spring 7 contacts with the periphery of the portion 3 to be punched out of the work stock 4 and moreover, the pressing force of the bottom surface recess 23 gradually increases relatively to the lowering of the ram 5 against the resilient force of the compression spring 7, so that the periphery of the portion 3 to be punched out is pressed against the peripheral edge of the die 9.

Thus, as the pressing force of the bottom surface recess 23 increases, the peripheral side part of the bottom surface recess 23 is outwardly expanded. As a result, the punch 10' statically contacts with the portion 3 to be punched out.

It is a matter of course that since the upper die 11 lowers while applying an external force to the work stock 4 in the meantime, the boss 15 gradually enters into the recess 20 of the pad 19, and the push rod 17 slides in the slide bushes 22, 24 of the pad 19 and the punch 10' until the proximal end of the step portion 16 of the push rod 17 connects with the contact surface of the punch 10'.

It is designed that under this condition, the distance between the lower die 2' and the upper die 11 is at least twice as much as the plate thickness of the work stock 4 and moreover, the recess 20 and the boss 15 have a gap therebetween at least as large as the plate thickness of the work stock 4.

Figure 4:
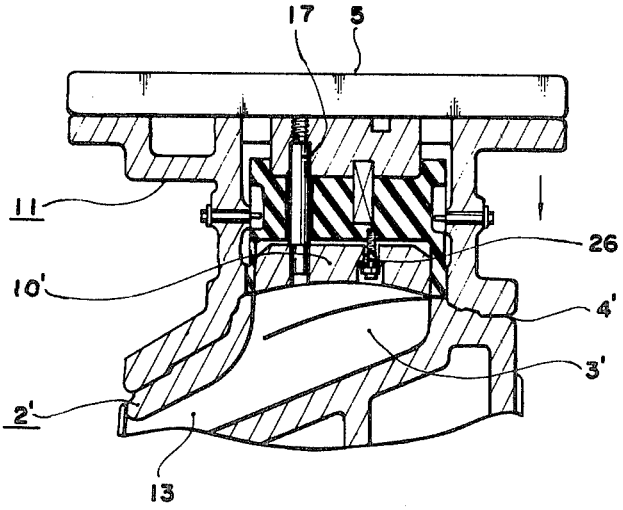
FIG. 4 illustrates the embodiment shown in FIG. 3 in a state having changed with time.

Thereafter, as shown in FIG. 4, the upper die 11 continuously applies an external force to the work stock 4 and at the same time, the proximal end of the push rod 17 presses the punch 10', so that the punch 10' applies a shearing force to the portion 3 to be punched out against the resilient force of the pusher pin 26. Thereby, the upper die 11 and the lower die 2' punch out the portion 3 to be punched out while properly plastically deforming the work stock 4, and the portion 3 to be punched out is discharged to the passage 13, as a punching scrap 3''.

Upon completion of a given pressing process, the ram 5 is lifted up by the crank means, and the upper die 11, the pad 19 and the punch 10' are reset to their initial postures, and then the work 4' thus formed into a given product shape is removed and carried to the subsequent process. On the other hand, a new work stock 4 is set on the lower die 2', and the above-described process is repeated.

It is a matter of course that the form embodying the invention is not limited to the above-described embodiment and various forms can be employed. For instance, the compression spring may be a gas spring, or punching may be replaced by drawing.

As described above, the invention provides a press machine structure displaying such excellent effects as follows. Since the press machine structure is basically such that the pad suspended from the upper die through spring means and the punch are connected together through another spring means, while the push rod provided to the upper die is faced to the punch so as to be able to press the same, as the upper die lowers, the pad simultaneously lowers, pressing the work stock against the spring means and moreover, the punch statically contacts with the work stock, and then, the punch is projected by means of the push rod so as to punch the work stock. Therefore, the rigidity of the pressing force of the pad against the work stock can be satisfactorily guaranteed in punching, so that the work stock is reliably fixed. Moreover, since the punch effects punching by means of a static load, no warpage is produced on the punched surface of the work stock. In addition, the tensile stress generated in bending never spreads to the punched surface, so that bending and drawing can be simultaneously effected. Thereby, it is possible to obtain products with a high dimensional accuracy.

Furthermore, since products with a high dimensional accuracy are manufactured, such secondary effects can be provided that control is facilitated, the mass-productivity is excellent, and the cost can be lowered.

What is claimed is:

1. A press machine for shaping and punching sheet work comprising:

an upper die having a cavity therein;

a lower die having a punch-receiving aperture therein smaller than and aligned with said cavity, said dies having opposed conforming surfaces about said cavity and said aperture to shape work pressed between said surfaces;

a resilient pad vertically movable in said cavity;

lost-motion means connecting said pad with said upper die;

spring means interposed between said upper die and said pad for urging said pad downward out of said cavity;

a punch disposed in a cavity in the underside of said pad;

means connecting said punch and said pad for urging said punch upward into said pad cavity while permitting limited movement of said punch downward out of said pad cavity; and lost-motion push means interposed between said upper die and said punch, whereby as said upper die is lowered and the work commences to be defomed between said opposed surfaces said pad contacts the work and presses it against the surface of said lower die peripherally about said aperture, and continued lowering movement of said upper die increases the pressure of said pad on the work and finally clamps the work between said pad and said peripheral surface of said lower die, shapes the work between said opposed conforming surfaces and engages said push means with said punch to punch the work.

2. The machine defined in claim 1 wherein the punch is a blanking punch.

* * * * *